United States Patent [19]

Schoeps et al.

[11] 4,291,074

[45] Sep. 22, 1981

[54] PROCESS FOR PRODUCING A SHEET OR STRIP WHICH IS LIGHTLY GALVANIZED ON ONE OR BOTH SIDES AND PRODUCTS OBTAINED BY SAID PROCESS

[75] Inventors: Bernard Schoeps, Strasbourg; Michel Forêt, Wantzenau, both of France

[73] Assignee: Laminoirs de Strasbourg, Strasbourg, France

[21] Appl. No.: 89,796

[22] Filed: Oct. 31, 1979

[30] Foreign Application Priority Data

Nov. 9, 1978 [FR] France ..... 78 31663
Oct. 9, 1979 [FR] France ..... 79 25090

[51] Int. Cl.[3] ..... C23C 1/02

[52] U.S. Cl. ..... 427/367; 118/101; 427/349; 427/368

[58] Field of Search ..... 427/349, 357, 367, 368; 428/659; 118/101

[56] References Cited

U.S. PATENT DOCUMENTS 1,252,363 1/1918 Roberts ..... 427/300
3,112,213 11/1963 Lusa ..... 427/209
3,260,577 7/1966 Mayhew ..... 427/357
4,120,997 10/1978 Franks et al. ..... 427/349
4,137,347 1/1979 Graft ..... 427/349
4,171,394 10/1979 Patil et al. ..... 427/349

FOREIGN PATENT DOCUMENTS 51-12581 4/1976 Japan ..... 427/349

*Primary Examiner*—Ralph S. Kendall
*Attorney, Agent, or Firm*—Sughrue, Mion, Zinn, Macpeak and Seas

[57] ABSTRACT

In this process there is determined, as a function of the conditions of the environment or other conditions, the distance from the surface of the bath at which the temperature of the zinc coating on the sheet or strip is in the range in which the zinc passes through a liquid-solid transitory state which is characterized by its friability. There is exerted at this point a mechanical action on at least one of the sides of the sheet or strip so as to completely remove away the whole of the non-alloyed zinc and allow to remain only a thin iron-zinc alloy coating whose thickness is between 1 and 2 μm, which represents an amount of alloy of between 7 and 15 g/m$^2$.

9 Claims, 6 Drawing Figures

PROCESS FOR PRODUCING A SHEET OR STRIP WHICH IS LIGHTLY GALVANIZED ON ONE OR BOTH SIDES AND PRODUCTS OBTAINED BY SAID PROCESS

DESCRIPTION

The present invention relates to the production of press-formable galvanized steel sheets or strips.

Attempts have been made for a long time to produce galvanized steel sheets or strips whose coating is very adherent, compact and hard, and there has been an increasing demand in recent years for thin galvanized sheets whose coatings is thin or weak for cold forming operations.

Although very considerable progress has been achieved in recent years in the manufacture of steel sheets or strips galvanized on one side and improvements have been made in the processes for continuously applying zinc-based coatings for the purpose of improving the adherence of the coating to the steel, decreasing the thickness of the zinc layer and improving the behaviour of the product in the course of successive operations in the use of the product, that is to say in the course of cold forming, welding, treatment of the surface before painting, painting and other operations, it has not yet been possible to obtain a product having at once an excellent resistance to corrosion, excellent weldability, a deep drawing or forming capability while ensuring a very good adherence of the paint.

Prior art:

Hot continuous galvanizing processes have been improved by methods which have improved the adherence, such as the use of a non-oxidizing pre-heating furnace, and have enabled the thickness of the zinc layer to be decreased and evened out, for example by a pneumatic wiping.

The products produced in this way are characterized by a pure zinc coating the thickness of which it has not been possible up to the present time to decrease below 3 to 5 μm, the total weight of the coating being still higher than 20 g/m$^2$ per side.

Such coatings are subject to jamming when cold forming if an abundant amount of lubricant is not employed. They require special settings for spot welding or seam welding, a more frequent maintenance of the electrodes and a drawing off of the zinc fumes at the welding stations. The surface treatments before painting and even the methods for applying the paint and the products employed must be adapted to the product if it is desired to obtain a surface appearance after painting which has the same gloss as for bare sheet steel and a correct adherence of the paint.

These special operating conditions have retarded the development of the use of continuously galvanized sheet metal in industries such as the automobile or electric household equipment industries.

In a complementary process employed in particular for obtaining galvanized products having differential coatings, such as disclosed in particular in French Patent No. 1,279,624 and U.S. Pat. No. 3,260,577, a part of the zinc is removed at the output end of the bath and the sheet or strip is heated so as to alloy the remaining zinc to the iron.

The products treated in this way have improved press-forming properties, are more easily weldable than the initial galvanized sheet and do not require special treatment before painting.

The alloy coating formed by the heat treatment adheres to the steel and is hard but has a tendency to soil or clog tools.

Although the behaviour of such products is good for most cold forming operations, it is found that in respect of severely swaged zones or zones subjected to very high pressures, the coating has a tendency to become powdery. It has not been possible up to the present time to decrease the thickness of such coatings to less than 6 to 7 μm, namely 40 g/m$^2$ per side and the zinc fumes formed must be drawn off in the region of the welding station.

The corrosion resistance of this product after phosphating and painting is comparable to that of sheet metal which has been painted, phosphated and galvanized under the best conditions. The adherence of the paint, tested by the shock test, is poor owing to the fragility of the subjacent alloy coating and, for a given thickness, the gloss of the paint is inferior to that of ungalvanized steel owing to the high rugosity of the subjacent alloy coating.

French Patent No. 77/14 240 discloses a process for producing a strip of ferrous metal coated with zinc on single side by hot dipping in which the side of the strip of metal from which it is desired to remove any zinc coating is wiped by means of powerful jets of gas until the zinc layer is reduced to about 10 g/m$^2$ and then the weakly coated side is heated in a furnace in order to form a fragile intermetallic layer. The coating thus obtained may finally be completely eliminated by a cold brushing, for example at the moment of using the product.

The product thus obtained is a steel sheet or strip which is galvanized on one side and is completely devoid of free or alloyed zinc on its other side. It consequently has both the drawbacks of the zinc coating on the galvanized side and those of unprotected steel on the side from which its coating has been removed.

The products obtained by means of these known processes consequently do not possess all the aforementioned properties together and the properties they do possess are not always found to be sufficient.

Consequently an object of the invention is to provide a process for producing hot galvanized steel sheet or strip having an extremely light or thin coating on one or two sides and properties which are greatly superior to those of sheets or strips which are galvanized on one of two sides obtained by the processes of the prior art.

Another object of the invention is to provide a hot galvanized press-formable steel sheet or strip which has all the aforementioned properties and is capable of being acted upon with methods employed for steel with no need to modify the equipment, the products or the manufacturing sequences.

The invention employs the well known fact that, when zinc is melted, it has a temporary state of very high friability in a temperature range which immediately precedes its melting point. Inversely, in passing from the liquid state to the solid state, the zinc passes through this same state of high friability a little after its complete solidification.

The invention provides a process for producing hot galvanized press-formable steel sheet or strip, having an extremely light coating on at least one side, which comprises passing the steel or strip continuously through a conventional hot dipping galvanizing bath and is of the type in which a part of the liquid zinc on the sheet or strip is scraped or wiped when it issues from the bath, wherein there is determined, in accordance with the conditions of the environment or other conditions, the distance from the surface of the bath at which the temperature of the zinc coating on the sheet or the strip is in the range in which the zinc passes through a liquid-solid transitory state which is characterized by its friability, and there is exerted at this point a mechanical action on at least one of the sides of the sheet or strip so as to completely remove the whole of the non-alloyed zinc and leave only a thin coating of iron-zinc alloy.

Advantageously, said mechanical action is a brushing effected by means of a cylindrical metal brush the temperature of which is controlled.

The invention also provides a product consisting of a steel sheet or strip obtained by means of the above defined process and having on said side, or on each of said brushed sides, a thin coating of an iron-zinc alloy having a thickness of between 0.3 μm and 4 μm, which represents an amount of alloy of between 2 and 30 g/m$^2$.

Preferably, this thickness is between 1 and 2 μm, which represents an amount of alloy of between 7 and 15 g/m$^2$.

The invention also provides a device for carrying out the aforementioned process and comprising a support located in the path of the strip above the surface of the bath and carrying mechanical means comprising at least one adjustable rotatable cylindrical metal brush having a controlled temperature and adapted to brush away the zinc on at least one side of the sheet or strip, and at least one opposing support roller in contact with the opposite side or sides of the sheet or strip, and means for independently adjusting the positions of the brush or brushes and of the roller or rollers in a direction parallel to and perpendicular to path of the sheet or strip and relative to the surface of the bath.

Tests carried on such a steel strip obtained by means of this process and this device and thus treated on both sides have revealed that this product has the following properties:

possibility of folding, press-forming, drawing, with no tearing away or dusting of the coating;

the sheet may be spot or seam welded by the MIG, MAG or TIG processes or braze welded with no modification of the regulations employed for mild steel; the wear of the electrodes is normal and the emanation of zinc vapour is very limited;

the sheet may be treated before application of paint under the same conditions as mild steel and it may be painted by any method employed for mild steel, with the use of the same primer, sealer and finishing paints with no modification of the conditions of application (dipping, electrophoresis, cataphoresis or anaphoresis with a gun, electrostatic etc);

the surface appearance of the painted sheets is the same as that obtained with bare steel having the same rugosity;

perfect adherence of the paint upon shock in all the standard tests;

the corrosion resistance of the painted phosphated sheet was examined by means of a salt mist test on a test piece cut with a cross according to the standard NF33 41002; it may be characterized by a complete absence of blistering, rusting or coming away of the paint by pulling with scotch along the cut after 1,000 hours;

the corrosion resistance of assemblies formed from sheets according to the invention welded with uncoated, phosphated and painted steel is unaltered in the region of the junctions;

the corrosion resistance of the painted phosphated sheet is unmodified by drawing or press-forming prior to the surface treatment, such as the erichsen test with a depth of 6 mm or the drawing test on a ring with a rate of deformation of 40%.

Further features and advantages of the invention will be apparent from the ensuing description with reference to the accompanying drawing which is given solely by way of example and in which.

Figure 3:
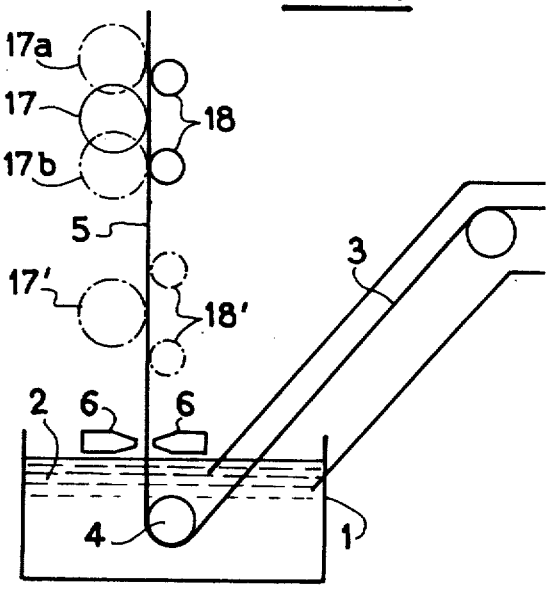
FIG. 3 is a diagrammatic view similar to FIG. 1 of a modification of the arrangement of the brush and the two support rollers.
Figure 1:
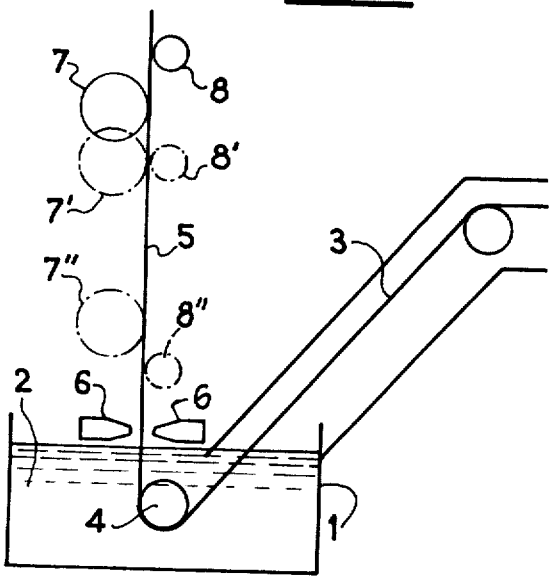
FIG. 1 is a diagrammatic elevational view of a conventional continuous galvanization installation comprising a device according to the invention mounted to act on a single side of a sheet or strip.
Figure 2:
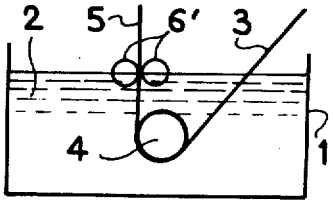
FIG. 2 is a partial diagrammatic view of a modification of a wiping device.

With reference to the drawing and more particularly to FIGS. 1 to 3, the device according to the invention is shown in its application to a conventional continuous hot dipping galvanizing installation and adapted to treat a single side of a sheet or strip so as to produce a product having on one side a normal zinc coating and on the other side an iron-zinc alloy coating which is completely devoid of non-alloyed zinc according to the invention.

The installation comprises in the known manner a tank 1 containing a galvanizing bath through which continuously travels a steel strip 3 which is to be galvanized and passes in the known manner around a roller 4 so that the galvanized strip 5 issues from the bath in the upward roughly vertical direction.

In leaving the bath, the galvanized strip 5 is first wiped by means of jets of air or other gas which are directed in opposite directions on opposite sides of the sheet by nozzles 6 which in the known manner sweep across the surface of the strip coated with molten zinc so as to remove excess zinc. By way of a modification, this wiping may be carried out by means of two cylinders 6' in the known manner, as shown in FIG. 2.

After issuing from the bath, the galvanized strip 5 passes through a mechanical device according to the invention for removing non-alloyed zinc from one of the coatings, this device being mounted in an adjustable manner above the surface of the bath. This device comprises a circular metal brush 7 which is disposed in such manner as to rotate in contact with one of the sides of the strip 5.

The device further comprises an opposing support cylinder 8 adapted to be in contact with the opposite side of the strip 5 in the region of the cylindrical brush 7 or offset from the latter.

The brush 7 is driven in rotation in one direction, preferably in the direction opposed to the direction of travel of the strip, and the roller 8, which provides a support for the brush 7, may be either freely rotatable so as to be driven by the effect of its contact with the strip, or itself driven in rotation in the suitable direction.

It is essential that the action exerted by the cylindrical brush 7 be applied to the strip according to the process of the invention a little after the solidification of the zinc on the strip and more precisely at the moment when the zinc is in the transistory liquid-solid state characterized by its friability, so as to be easily detached from the surface of the strip while avoiding the clogging of the brush.

It will be understood that the distance from the surface of the galvanizing bath at which the zinc coating deposited on the strip starts to possess this friability state, is a function of a number of variable factors. Consequently, this distance may vary and, in order to ensure that the desired mechanical action on the side of the strip is always exerted in the appropriate temperature range of the latter, the brush 7 and the support roller 8 are mounted to be independently adjustable along the path of the strip. Thus it is possible to shift the brush 7 and its opposing roller 8 along this path, as shown for example at 7', 8' and 7'', 8'' in FIG. 1.

The effectiveness of the mechanical action of the brush 7 on the zinc deposited on the strip 5 depends in particular on the characteristics of this brush, that is to say its diameter, its hardness and the disposition and the nature of the metal wires forming the brush and its speed of rotation and the pressure it exerts on the surface of the strip.

The support roller 8 may have a smooth surface or a surface having a uniform but variable rugosity or an etched pattern known in the art so as to impart to the side carrying the conventional galvanized coating an appearance which is identical to the surface of the roller and enable the user to easily distinguish the sides of the strip or sheet.

FIG. 3 shows a modification of the arrangement of the brush 17 in which there are provided two support rollers 18 which are disposed on the other side of the strip, on each side of the axis of the brush 17, so that its action on the strip is then partly a function of the tension of the latter.

Also in this modification, the height of the device must be adjusted relative to the surface of the galavanizing bath as shown in 17' and 18'. Further, the relative positions of the brush 17 and the rollers 18 may also be adjusted as shown at 17*a* and 17*b* in FIG. 3.

Figure 5:
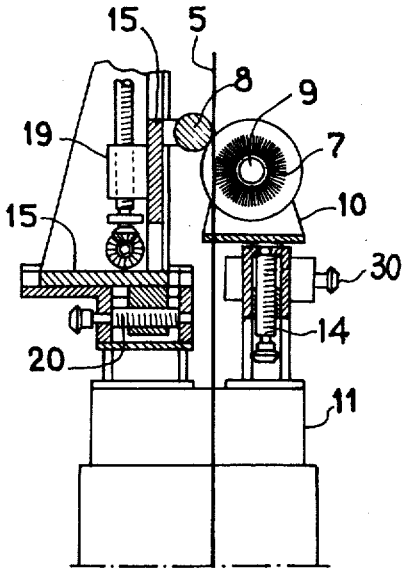
FIG. 5 is a sectional view taken on line 5—5 of FIG. 4.
Figure 4:
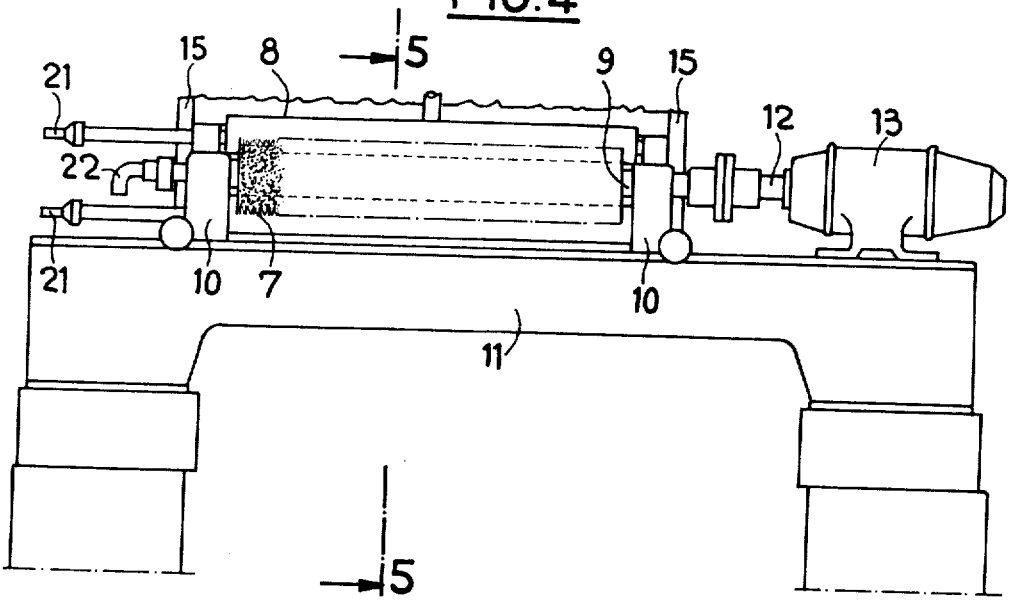
FIG. 4 is a front elevational view of a device having an adjustable brush according to the invention.

FIGS. 4 and 5 show an embodiment of a device for carrying out the process according to the invention for treating a single side of a sheet or strip.

The rotary metal brush 7 is mounted on a shaft 9 which is journalled in end walls 10 which are fixed to a support 11 adjustable in height. The shaft 9 is coupled to the output shaft 12 of a dc motor 13 whereby it is possible to easily regulate the speed of rotation of the brush 7. The support 11 may be adjusted in height by means of any suitable device, for example comprising a screw such as shown at 14. The brush may also be adjusted horizontally in a direction perpendicular to the path of the strip by means of screw devices 30.

The support rollers 8 are mounted parallel to rotate in a support 15 which is adjustable both in height in a direction parallel to the path of the strip and in a direction perpendicular to the strip by means of two devices 19 and 20 respectively. for example employing screws. Thus it is possible not only to displace the axes of the rollers 8 relative to the axis of rotation of the brush 7 but also to adjust the pressure exerted by the device on the strip on each side of the latter and also the tension exerted on the strip.

Means are provided for cooling the brush and the support roller or rollers by a circulation of a suitable cooling fluid through pipes 21, 22 respectively.

It will be understood that means other than the brush 17 may be employed for removing the zinc non-alloyed to the surface of the sheet or strip, provided that these means are disposed in the desired place relative to the galvanizing bath to act on the zinc coating at the moment when the latter is in the suitable temperature range.

It will be easily understood that it is possible to provide along the path of the strip or sheet, downstream of the brush 7 and roller 8, other brushes or suitable mechanical, chemical, electrolytic or other devices for ensuring the elimination of the residues and the finishing treatment.

In this way it is possible, by means of the process and device according to the invention, to directly produce a steel sheet or strip which is galvanized on one side and has an opposite side which has only an extremely light iron-zinc alloy coating. The zinc detached from the surface may be subsequently recovered.

It will be observed that in a high-output galvanizing installation there may be easily provided means adapted to automatically adjust the position of the device relative to the surface of the galvanizing bath so that the abrasive action of the brush 17 is always exerted in the region of the strip where the zinc coating is in its state of friability, these means being controlled in a conventional manner by sensors responsive to the different factors which affect the temperature of the coating.

These means are well known in the art and are not part of the present invention and consequently will not be described.

Figure 6:
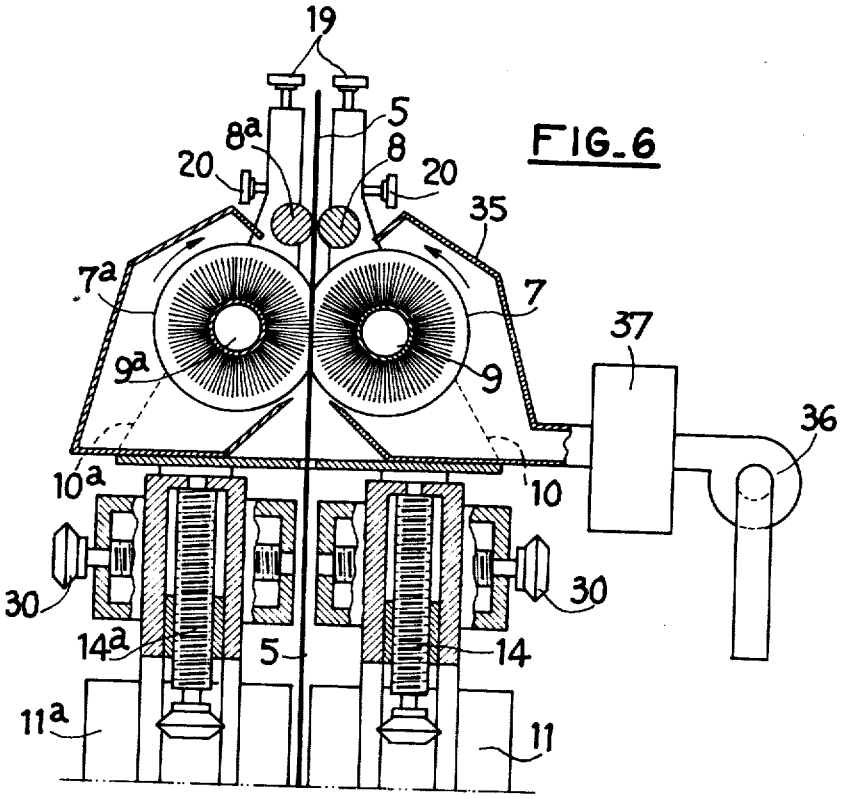
FIG. 6 is a diagrammatic side elevational and sectional view of a device acting on both sides.

FIG. 6 shows diagrammatically an embodiment of a device according to the invention in its application to the production of a product which is treated on both sides, and it is consequently installed at the output end of a conventional hot dipping galvanizing installation so that the galvanized strip 5 passes, after a conventional wiping, between two circular metal brushes 7, 7*a* which are disposed in such manner as to rotate in contact with the strip 5 on each side of the latter.

The mounting of the brushes on each side of the strip is identical and the arrangement of only one thereof will be described.

The brush 7 is mounted on a hollow shaft 9 which is journalled on a support 10 and is vertically adjustable by means of a screw 14 disposed at each end of the shaft 9.

This assembly is moreover mounted to be adjustable in the horizontal direction on the support 11, in a direction perpendicular to the plane of the strip 5, by means of a screw 30 whereby it is possible to shift the brush 7 toward or away from the surface of the strip.

A support roller 8 is mounted above the shaft 9 of each brush at a fixed adjustable distance from the brush and the strip.

As in the foregoing embodiment, this support roller 8 is adapted to ensure, jointly with the opposing roller 8*a* which is part of the symmetrical device, the appropriate tension of the strip in contact with the brushes 7, 7*a*. with no transverse bending.

The many trials carried out by the Applicant have revealed that the characteristics of the brush or brushes, that is to say its diameter, the density of its bristles, the diameter and the length of the steel wires forming it, their nature, their temperature and the relative linear velocity between the brush or brushes and the sheet, and the distance therebetween (that is to say the pressure exerted on the sheet by the brush or brushes), are so many critical factors which jointly result in the production of a final product having such characteristics that it has optimum properties.

The properties of resistance to drawing, seizure, deep drawing, corrosion, etc . . . of the product according to the invention are ensured by a compact iron-zinc alloy coating having no visible rugosity, a thickness of about 1.5 μm and comprising about 80% of phase δ and about 30% of phase ξ.

This alloy coating is obtained on one side or on both sides of the sheet or strip by means of the process according to the invention, in which there is employed at least one cylindrical brush having steel wires or bristles of a diameter of 5/100 to 50/100 mm and a length of between 35 and 185 mm, the brush itself having a diameter of between 200 and 500 mm, the distance between the brushed surface and the envelope of the brush from which the bristles extend being between 30 and 150 mm.

This brush or brushes are made to rotate in the direction opposed to the travel of the sheet or strip so that the relative velocity between the brush and sheet is between 15 m/s and 80 m/s.

The temperature of the sheet, on one hand, in the region of the brush or brushes, and the temperature of the bath, on the other hand, are so chosen that the zinc reaches the region of the brush or brushes with a temperature a little higher than its temperature of solidification.

In a typical installation, the temperature of the sheet in the region of the brush or brushes is between 410° and 450° C. and the temperature of the base of the bristles of the brush or brushes is maintained at a temperature of no more than 50° C.

In other words, this amounts to adjusting the distance between the device and the exit of the bath automatically by means of a mechanism known per se which is controlled by heat sensors or other suitable detectors which apply to this mechanism electrical control signals.

Advantageously, the device comprises, in the vicinity of each brush, a collector 35 connected to a blower 36, or other suitable suction device, through a filter 37 or the like in which the particles of solid zinc torn away by the brushes are retained.

The function of the support rollers 8, 8*a* is to maintain the sheet or strip, on one hand, against any transverse bending and, on the other hand, at a fixed distance from the brushes. Their temperature is consequently low enough to avoid any adhesion of the zinc on their surface.

Tests comprising the drawing of Swift cups were carried out on blanks degreased with trichlorethylene before the drawing of a sheet treated according to the invention on both sides and, by way of a reference, on a bare steel sheet for deep drawing ES and degreased under the same conditions. The ratio between the diameter of the blank and the diameter of the flat-bottomed cup is 2.

Under these exceptionally severe conditions it is possible to adjust the pressure of the holding down clamp to obtain correct drawn parts with the sheet according to the invention, without breakage or trace of seizure and with the trace of folds appearing only on the inside. The limit to the number of drawn parts it is possible to produce under these conditions was not found.

On the other hand, in respect of bare ES steel, the first cup shows cracks and contractions and the following systematically break irrespective of the adopted pressure of the holding down clamp owing to seizures at the entrance radius of the die.

In these tests, no dusting or tearing away of the zinc coating from the tested sheet was observed.

Vickers microhardness tests carried out on the alloy revealed that the hardness of the layer is between 250 and 420 HV, depending on the state of the stressing of the surface.

Note that the zinc torn away by the brush or brushes is recovered in the collectors 35 in a noble form, enabling it to be used again industrially, which constitutes another advantage of the process and device according to the invention.

Having now described our invention what we claim as new and desire to secure by Letters Patent is:

1. In a process for producing a hot galvanized press-formable steel sheet or strip having an extremely light coating on at least one side, comprising continuously passing the sheet or strip in a conventional hot dipping galvanizing bath and scraping or wiping a part of the liquid zinc on the sheet or strip when it issues from the bath; the improvement comprising determining the distance from the surface of the bath of a region of the sheet or strip in which the temperature of the zinc coating on the sheet or strip is in the range in which the zinc passes through a liquid-solid transitory state which is characterized by the friability of the zinc, and exerting in this region a mechanical action on at least one of the sides of the sheet or strip a little after the complete solidification of the zinc so as to completely remove the whole of the non-alloyed zinc and leavy only a thin layer of iron-zinc alloy.

2. In a process for producing a hot galvanized press-formable steel sheet or strip having an extremely light coating on at least one side, comprising continuously passing the sheet or strip in a conventional hot dipping galvanizing bath and scraping or wiping a part of the liquid zinc on the sheet or strip when it issues from the bath; the improvement comprising determining the distance from the surface of the bath of a region of the sheet or strip in which the temperature of the zinc coating on the sheet or strip is in the range in which the zinc passes through a liquid-solid transistory state which is characterized by the friability of the zinc, and exerting in this region a mechanical action on at least one of the sides of the sheet or strip so as to completely remove the whole of the non-alloyed zinc and leave only a thin surface layer of iron-zinc alloy, said mechanical action being exerted by at least one cylindrical metal brush, maintaining the wires or bristles of the brush at a temperature which is at every point a little lower than the temperature of solidification of the zinc, maintaining the sheet or strip in the region of the brush at a temperature which is such that the brush initiates the solidification of the zinc and cools it sufficiently for ejecting it in the form of solid particles.

3. A process as claimed in claim 2, wherein the temperature of the base of the bristles of the brush is maintained, by means of the circulation of a cooling agent, higher than 50° C., and the temperature of the sheet or strip in the region of the brush is between 410° and 450° C.

4. A process as claimed in claim 3, wherein there is employed a brush comprising steel wires fixed to a hollow cylindrical case, said wires having a diameter of 5/100 to 50/100 mm and a length of between 35 and 185 mm, the total diameter of the brush being between 200 and 500 mm.

5. A process as claimed in claim 4, wherein the brush is maintained relative to the sheet or strip in such manner that the distance between the base of the bristles and the brushed surface is between 30 and 180 mm.

6. A process as claimed in claim 5, wherein the brush is rotated in the direction opposed to the travel of the sheet or strip in such manner that the relative velocity between the brush and sheet or strip is between 15 meters per second and 80 meters per second.

7. In a process for producing a hot galvanized press-formable steel sheet or strip having an extremely light coating on at least one side, comprising continuously passing the sheet or strip in a conventional hot dipping galvanizing bath and scraping or wiping a part of the liquid zinc on the sheet or strip when it issues from the bath; the improvement comprising determining the distance from the surface of the bath of a region of the sheet or strip in which the temperature of the zinc coating on the sheet or strip is in the range in which the zinc passes through a liquid-solid transitory state which is characterized by the friability of the zinc, and exerting in this region a mechanical action on at least one of the sides of the sheet or strip a little after the complete solidification of the zinc so as to completely remove the whole of the non-alloyed zinc and leave only a thin surface layer of iron-zinc alloy having a thickness of between 0.3 $\mu$m and 4 $\mu$m, representing an amount of alloy of between 2 g/m$^2$ and 30 g/m$^2$.

8. A process as claimed in claim 7, wherein said thickness is between 1 $\mu$m and 2 $\mu$m, representing an alloy thickness of between 7 and 15 g/m$^2$.

9. A process as claimed in claim 7 or 8, wherein said iron-zinc alloy coating comprises about 80% of phase $\epsilon$ and 20% of phase $\epsilon$.

* * * * *